US006336285B1

(12) United States Patent
Baumer

(10) Patent No.: US 6,336,285 B1
(45) Date of Patent: Jan. 8, 2002

(54) SIGHTING APPARATUS

(76) Inventor: Allen P. Baumer, 3224 Kaiser, P.O. Box 464, Pinconning, MI (US) 48650

( * ) Notice: Subject to any disclaimer, the term of this patent is extended or adjusted under 35 U.S.C. 154(b) by 0 days.

(21) Appl. No.: 08/818,442

(22) Filed: Mar. 17, 1997

(51) Int. Cl.[7] ..... F41G 1/16; F41G 1/32

(52) U.S. Cl. ..... 42/124; 42/113; 42/119; 42/122; 42/123; 42/126; 42/130; 42/132; 42/141

(58) Field of Search ..... 42/101, 103, 112, 42/113, 119, 122, 123, 124, 125, 126, 130, 132, 133, 141; 33/245, 246, 247, 248, 249, 250

(56) References Cited

U.S. PATENT DOCUMENTS

| | | | | | |
|---|---|---|---|---|---|
| 374,202 | A | | 12/1887 | Rice | |
| 1,009,282 | A | * | 11/1911 | Cobb | 33/246 |
| 3,276,127 | A | | 10/1966 | Abrahamson | 33/50 |
| 3,626,597 | A | | 12/1971 | Darrah | 33/252 |
| 3,875,675 | A | | 4/1975 | Kirsay | 33/245 |
| 4,299,044 | A | | 11/1981 | Johannsen | 42/100 |
| 4,688,345 | A | | 8/1987 | Kilgour | 42/101 |
| 4,707,772 | A | * | 11/1987 | Jimenez et al. | 33/241 |
| 4,742,635 | A | | 5/1988 | Ruger et al. | 42/101 |
| 4,777,730 | A | | 10/1988 | Huggins | 33/245 |
| 4,841,659 | A | | 6/1989 | Williams | 42/101 |
| 5,033,219 | A | * | 7/1991 | Johnson et al. | 42/101 |
| 5,737,070 | A | * | 4/1998 | Vasquez et al. | 42/103 |
| 5,887,375 | A | * | 3/1999 | Watson | 42/100 |

FOREIGN PATENT DOCUMENTS

| | | | | |
|---|---|---|---|---|
| CH | 348896 | * | 10/1960 | 33/246 |
| DE | 521955 | * | 3/1931 | 33/249 |
| GB | 1572356 | * | 7/1980 | 33/245 |
| SE | 106056 | * | 12/1942 | 42/101 |

* cited by examiner

*Primary Examiner*—Stephen M. Johnson
(74) *Attorney, Agent, or Firm*—John J. Swartz

(57) ABSTRACT

Sighting apparatus for mounting open sights atop a firearm sighting telescope including a longitudinal sighting bar which is mounted on the telescope. The front sight is mounted on the front portion of the bar and the rear sight is mounted on the rear portion of the bar. The front and rear portions of the bar may be longitudinally adjustable to longitudinally adjust the distance between the front and rear open sights. In one embodiment, the front sight is an optical sight.

41 Claims, 4 Drawing Sheets

SIGHTING APPARATUS

BACKGROUND OF THE INVENTION

1. Field of the Invention

This invention relates to open sights for a firearm and more particularly, to apparatus for mounting open sights atop a firearm mounted telescope.

2. Description of the Prior Art and Objects

A traditional firearm includes so-called "iron sights" or open sights mounted atop a firearm barrel. To improve shooting accuracy, telescopic sights, sometimes referred to as telescopes and/or scopes, have been mounted on firearms to improve shooting accuracy over long ranges. Initially, when telescopes were mounted atop firearms, the mounts interfered with the line of sight for the gun mounted open iron sights. In order for the shooter to have access to the iron sights, the scope had to be raised and the height of the mounts was increased to elevate the scope. This height increase created a problem for scope sighting because the shooter had to raise his cheek on the gun stock thereby causing control problems when viewing through the scope. Horizontal openings were provided in the mounts, in longitudinal alignment with the iron sights, to aid viewing, however, the limited breadth of view through these openings restricted the shooter's scope of vision. Moreover, a disadvantage of this type prior art scope mount is that the scope is normally the primary sighting system, and when the scope is mounted a greater distance away from the barrel, the shooting accuracy is decreased. By lowering the scope and installing the sight bar constructed according to the present invention, the cheek-to-gunstock contact area is greatly increased. The cheek to gunstock contact area is so important that some gun manufacturers build up this area for a more comfortable shooting condition. Accordingly, it is an object of the present invention to provide a sighting system which will improve shooting accuracy.

It is another object of the present invention to provide new and novel apparatus for mounting sights on a firearm.

Yet another object of the present invention to provide a sighting system of the type described which will mount the primary telescopic sight closer to the firearm than the open sights that are mounted in vertically spaced relation above the telescope.

There is another type of mount which mounts the scope to a side of the firearm barrel. A disadvantage of this type mount, as well as the aforementioned mount which raises the scope a substantial distance above the iron sights, is that the shooter must move his head and eyes sidewisely and/or vertically from its normal shooting position. This adjustment can be uncomfortable and is not the normal position one would assume for shooting. This change of posture detracts from the accuracy of shooting. Accordingly, it is another object of the present invention to provide a scope mount which will minimize any change in the shooter's posture required for the shooter to sight through the scope.

The use of iron sights is normally used for shooting at very short distances, however, it is very difficult for the shooter, under field conditions, to "find the target" when one is viewing through the "holes" in the mount. It is advantageous to have open iron sights for shooting at short ranges or fast moving targets.

The sighting problem is particularly exacerbated with a hand gun because the scope is normally a substantial distance away from the user's eye and any movement of the scope tends to cause one to "lose the target". Scope mounts, having tubular openings therethrough and disposed below the telescope, are illustrated in U.S. Pat. No. 4,688,345 issued to Norman G. Kilgour on Aug. 25, 1987 and U.S. Pat. No. 3,875,675 issued to Robert J. Krisay on Apr. 8, 1975. A scope mounted on a pistol is illustrated in U.S. Pat. No. 4,742,635 issued to William B. Ruger et al on May 10, 1988.

Attempts have heretofore been made to mount the open sights above a sighting telescope, such as that illustrated U.S. Pat. No. 4,841,659, issued to Paul D. Williams on Jun. 27, 1989; U.S. Pat. No. 374,202, issued to R. C. Rice on Dec. 6, 1887; U.S. Pat. No. 3,626,597, issued to Chester R. Darrah on Dec. 14, 1971; and U.S. Pat. No. 4,777,730, issued to Edward R. Huggins on Oct. 18, 1988. These prior art, front and rear, open sights are mounted independently of each other. If the scope sights in the aforesaid patents are removed from the scope for any reason, it is difficult to realign the sights. Accordingly, it is an object of the present invention to provide new and novel apparatus for mounting open sights atop a telescope which will overcome the problems of the prior art.

Still another object of the present invention to provide a new and novel common mount for mounting both front and rear open sights on a sighting telescope.

It is another object of the present invention to provide new and novel open sight mounting apparatus which will maintain the relative relationship and orientation of the sights even though removed from the firearm to keep and maintain the sighting relationship of the front and rear sights relative to each other.

It is another object of the present invention to provide open sight mounting apparatus for mounting open sights on a sighting telescope and maintaining the orientation and alignment when the sights are removed from the telescope.

It is a further object of the present invention to provide new and novel sight mounting apparatus including a longitudinally extending sighting bar which is mounted above a scope for mounting front and rear open sights.

A still further object of the present invention to provide apparatus for mounting front and rear, longitudinally spaced apart open sights in vertically spaced relation with an underlying telescope.

The prior art mounting devices are adapted for a particular scope and would be ineffective with another scope having an enlarged front eye piece, for example, because the front eye piece would interfere with the viewing. Accordingly, it is a further object of the present invention to provide new and novel open sight mounting apparatus of the type described which is adaptable for use with a wide variety of scopes and is not of singular purpose.

The problem of sighting with or without a scope mounted on a pistol is further exacerbated. The front and rear sights on a conventional pistol are longitudinally spaced a relatively short distance which tends to decrease the shooting accuracy. It has been generally found that the further apart the front and rear sights can be separated, the more shooting accuracy will improve. In apparatus constructed according to the present invention, a longitudinal bar is provided for mounting the front and rear open iron sights. The bar can be made of sufficient length that the front and rear sights can be mounted forwardly and rearwardly, respectively, of the scope, and forward and rearwardly, respectively, of the mounts for mounting the bar on the scope. Accordingly, it is another object of the present invention to provide open sight mounting apparatus which will separate the front and rear open sights further apart than the mounts for the scope are separated, further apart than the mounts for mounting the bar on the scope are separated, and further apart than the open iron sights on the pistol are separated.

It is a further object of the present invention to provide sighting apparatus of the type described including a sighting bar which includes longitudinally adjustable sections that are slidably mounted relative to each other to selectively extend and contract the length of the sighting bar and selectively position the sights at any selected one of a plurality of longitudinally spaced apart variable distances.

When shooting a firearm at dusk or dark with open sights, it can be difficult to properly align the front and rear sights. It has been traditional heretofore to utilize optical sights on or in connection with a bow utilized to propel an arrow. Such optical sights are utilized when the bowman is shooting at dusk or dark. The optical sights include a light emitting diode (LED) selectively coupled to a battery with a switch. The bowman merely aligns the LED of a front, bow mounted optical sight with a rear bow mounted sight which may also comprise an LED.

Such optical sights have not been utilized on a firearm barrel. Accordingly, it is another object of the present invention to provide new and novel apparatus for mounting an optical sight on a firearm.

It is another object of the present invention to provide a new and novel apparatus for mounting a light emitting diode and/or an optical sight on or in connection with a firearm.

It is a further object of the present invention to provide a mechanism for mounting a light emitting sight atop a firearm.

Other objects and advantages of the present invention will become apparent to those of ordinary skill in the art as the description thereof proceeds.

SUMMARY OF THE INVENTION

Open sight mounting apparatus for mounting front and rear open sights atop an elongate sighting telescope comprising: an elongate sighting bar having a front end portion for mounting a front open sight, and a longitudinally rearwardly spaced rear end portion for mounting a rear open sight longitudinally rearwardly spaced from the front open sight; and mechanism for mounting the sighting bar atop a sighting telescope.

DESCRIPTION OF THE DRAWINGS

The invention may be more readily understood by referring to the accompanying drawings, in which.

DESCRIPTION OF PREFERRED EMBODIMENT

Figure 1:
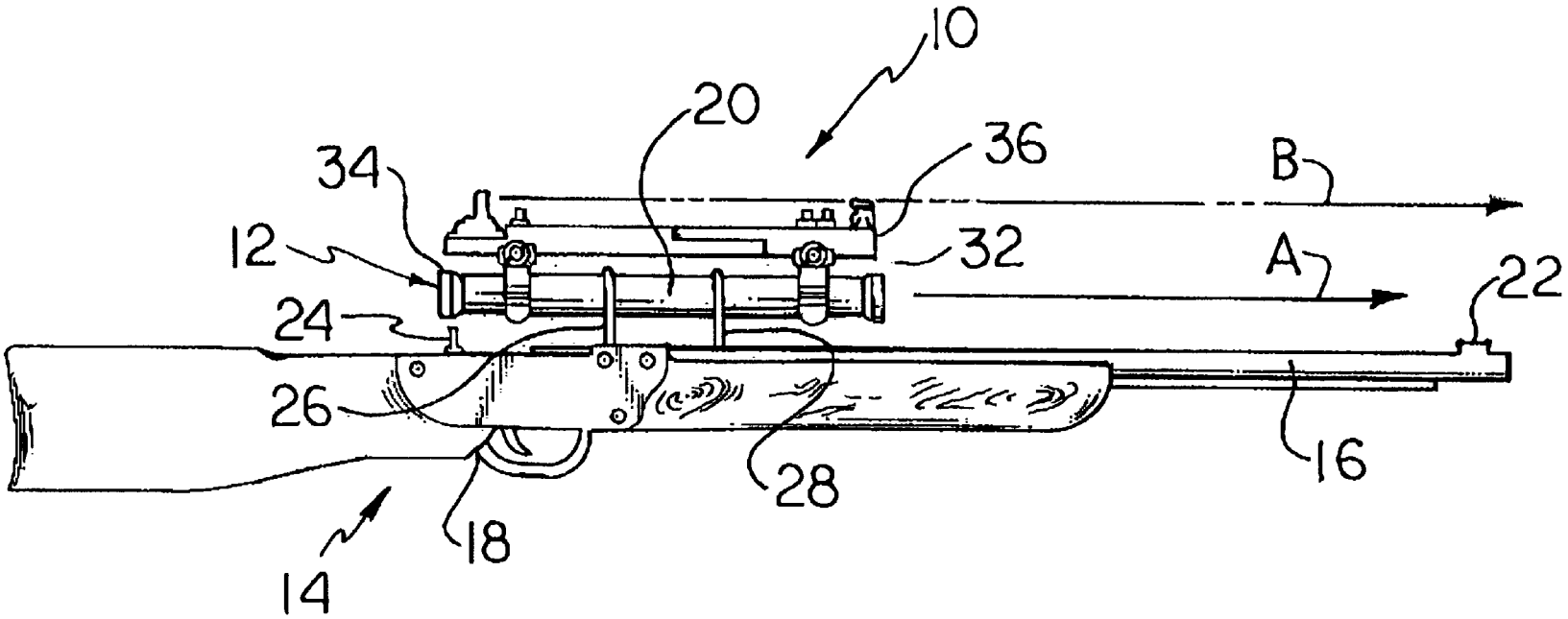
FIG. 1 is a side elevational view generally illustrating sighting apparatus constructed according to the present invention mounted atop a sighting telescope which, in turn, is mounted atop a firearm.
Figure 2:
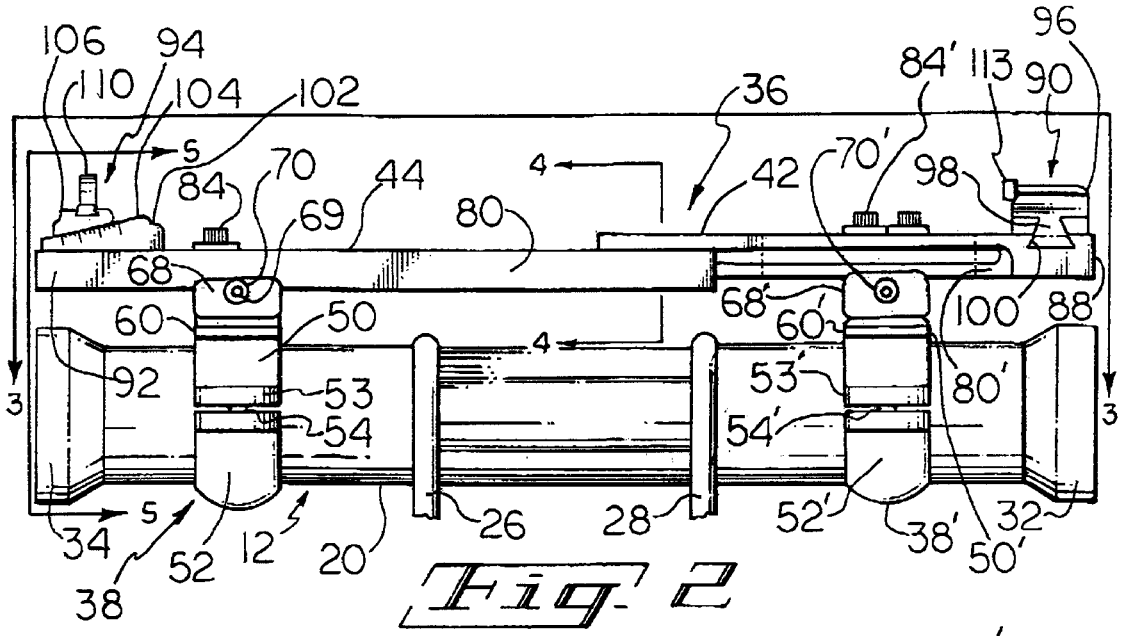
FIG. 2 is a greatly enlarged side elevational view of sighting apparatus constructed according to the present invention.
Figure 3:
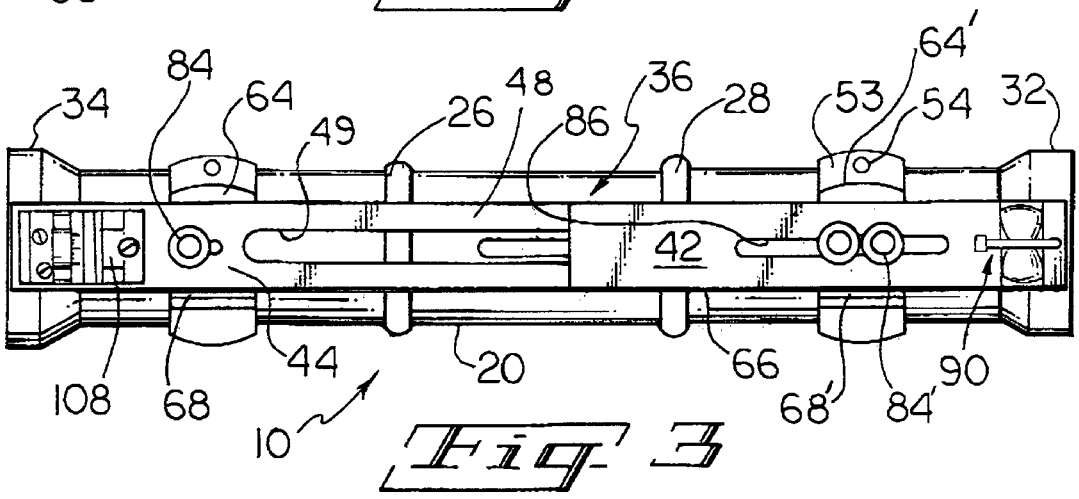
FIG. 3 is a top plan view thereof, taken along the line 3—3 of FIG. 2.

Sight mounting apparatus, generally designated 10, is particularly adapted for use with a telescopic sight, generally designated 12, mounted on the barrel 16 of a firearm 14 having a hand grip 18. Firearms typically include front and rear sights 22 and 24, respectively, mounted on the firearm barrel 16. The sighting telescope 12 is illustrated as including a central tubular body 20 coupling enlarged diameter front and rear, cylindrical, magnifying lens portions 32 and 34, respectively. Right angularly related cross hairs 25 are centrally mounted in the tubular body 20 between the lens portions 32 and 34, as usual. Cross hair adjusting mechanism (not shown) may be provided for adjusting the position of the cross hairs, if desired, to aid in the sighting in the weapon.

The scope 12 is mounted on the gun barrel 16 via a pair of longitudinally spaced adjustable scope mounting rings, schematically illustrated at 26 and 28, of conventional construction coupled to the tubular scope body 20. The apparatus 10 constructed according to the present invention is adapted for use on a wide variety of telescope sights and firearms of various and differing constructions.

The sighting apparatus 10 constructed according to the present invention is more particularly illustrated in FIGS. 2–5 and includes a sighting bar, generally designated 36, which is mounted on the tubular body 20 of the scope 12 via rear and front, adjustable bar mounting rings, generally designated 38 and 38', respectively. The parts of the front bar mounting ring 38' which are identical to the parts of rear bar mounting ring 38 will be identified by identical reference characters followed by a prime subscript.

Figure 4:
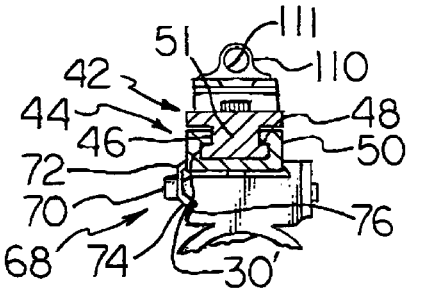
FIG. 4 is a front sectional view thereof, taken along the section line 4—4 of FIG. 2.

The sighting bar 36 comprises front and rear sighting bar slides 42 and 44, respectively, which are slidably interconnected for to-and-fro longitudinally adjusted movement between anyone of a plurality of longitudinally adjusted positions relative to each other. As illustrated in FIG. 4, the front bar slide 42 includes a pair of longitudinally extending, laterally outwardly opening side grooves 46. The rear slide 44 is generally U-shaped in vertical cross section and includes a pair of upstanding legs 50 having longitudinally extending, laterally inwardly disposed, opposing flanges 48 which are slidingly received in the side grooves 46. The rear slide 44 includes an upwardly opening, longitudinal slot 49 between the opposed flanges 48 which slidably receives a central upstanding web 51 that provides the base for each of the grooves 46.

The rear bar mounting ring 38 includes a pair of upper and lower scope receiving sections 50 and 52 (FIGS. 2 and 5), respectively, having distal ends 53 releasably interconnected by a pair of diametrically opposed bolts 54. The scope receiving sections 50 and 52 include opposing semi-cylindrical grooves 56 and 58 which are complimentary to the central, cylindrical, tubular body 20 of the scope 12.

The upper scope receiving section 50 of bar mounting ring 38 includes an integral upper sighting bar mounting block portion 60 having a top flat surface 62 for receiving the rear bar section 44. The upper mounting block portion 60 includes, along one lateral upper edge, an anvil flange 64 against which one side 66 of the rear bar section 44 is detachably clamped via a clamp, generally designated 68, provided on the laterally opposite side 67 of block portion 60.

The clamp 68 includes a bore therethrough slidably receiving a laterally outwardly extending screw 69 extending laterally outwardly from the opposite side 67 of block 60. The clamp 68 has a lower portion 74 which is received in a longitudinally extending V-shaped slot 76 in the side 67 of block portion 60. The clamp 68 also includes an upper flange 78 for engaging the opposite side wall 80 of the rear sighting bar 44. By turning a nut 70 threaded on the screw 69 about its axis in opposite directions, the clamp 68 can selectively engage and disengage the rear mounting bar 44 to selectively clamp and release the position of the bar 44 relative to the telescopic sight 12.

The front clamp ring 38' is generally similar to the rear clamp ring 38 and will be identified by identical reference characters followed by a prime subscript. The rear mounting flange, will engage the side wall 80' of the front bar slide 42.

The position of the rear bar slide 44 relative to the front bar slide 42 and to the rear mounting ring 38 is detachably fixed via a vertically disposed screw 84 which is received in mounting block 60. The front bar slide 42 is fixed to front ring 38' via a pair of screws 84' which are slidingly received in an elongate slot 86 that extends through the front sighting bar slide 42 and is threadedly received in the front mounting block 60'.

The front nut 70', of course, detachably clamps the clamp 68', the front sighting bar slide 42 and the front sighting bar receiving mount 60' together.

The front end portion 88 of the front sighting bar slide 42 mounts a front open iron sight, generally designated 90, and the rear portion 92 of the rear sighting bar slide 44 mounts an open iron sight, generally designated 94, of conventional construction. The front sight 90 is illustrated as an upstanding blade 96 mounted on a laterally adjustable dove tail slide 98 which is slidably, snuggly received in a complimentary groove 100 disposed transversely in the front portion 88 of the elongate front sighting bar slide 42.

Generally, the rear sight 94 includes a rear sight ramp 102 having an upper inclined surface 104 which mounts a sighting block 106. A longitudinally extending dove tail slide 108 (FIG. 3) is slidably received in a complementally formed slot in sighting block 106 which mounts a peep sight, generally designated 110, having a circular sight opening 111. The rear sight 94 is commercially available and is illustrated with particularity in U.S. Pat. No. 4,841,659 which is incorporated herein by reference as though fully set forth herein word for word. The upper end of the front sight blade 96 includes an integral circular sighting bead 113 which the shooter centrally aligns with the rear, circular sight opening 111, as illustrated in FIG. 5.

The Operation

Figure 5:
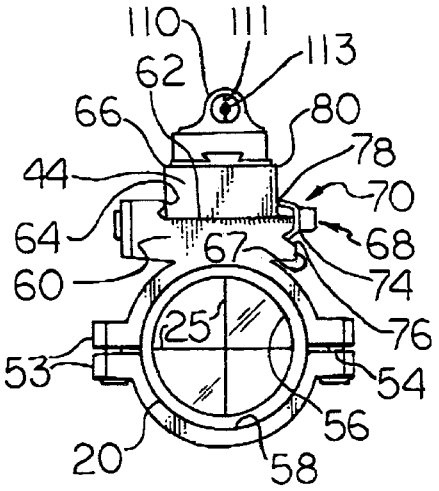
FIG. 5 is a rear elevational view, taken along the section line 5—5 of FIG. 2.

In operation, the user can selectively sight along a sighting axis A through the telescopic sight 12 or along a sight line B aligning the rear peep sight 111 with the front sight bead 113 provided on the upper end of front sight blade 96 (FIG. 5). The firearm, generally designated 14, may suitably comprise a hand gun, rifle or shot gun. If the sighting bar 36 is utilized on a pistol, it may be desirable to spread the front and rear open sights 90 and 110 farther apart than the conventional sights provided on the pistol. It has been found that sighting shooting accuracy improved with sights which are spread.

The scope can be sighted in by adjusting the scope mounting rings 26, 28, and/or the position of the cross hairs 25, as usual.

The relative positions of the front and rear sights 90 and 94, respectively can be adjusted by adjusting either the sighting bar mounting rings 38, 38' or by adjusting the lateral position of dove tail slide 98 and/or the vertical and horizontal positions of sighting block 106 on rear sight ramp 102 until the user is satisfied with the shooting accuracy. The clamping members 68, 68' and nuts 70 and 70' may be set once the desired positions of the slides 42, 44 and the sights 90 and 94 are finally determined.

Alternate Embodiment

Figure 7:
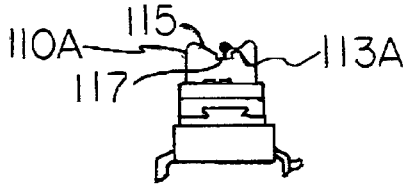
FIG. 7 is a rear elevational view, taken along the section line 7—7 of FIG. 6.
Figure 6:
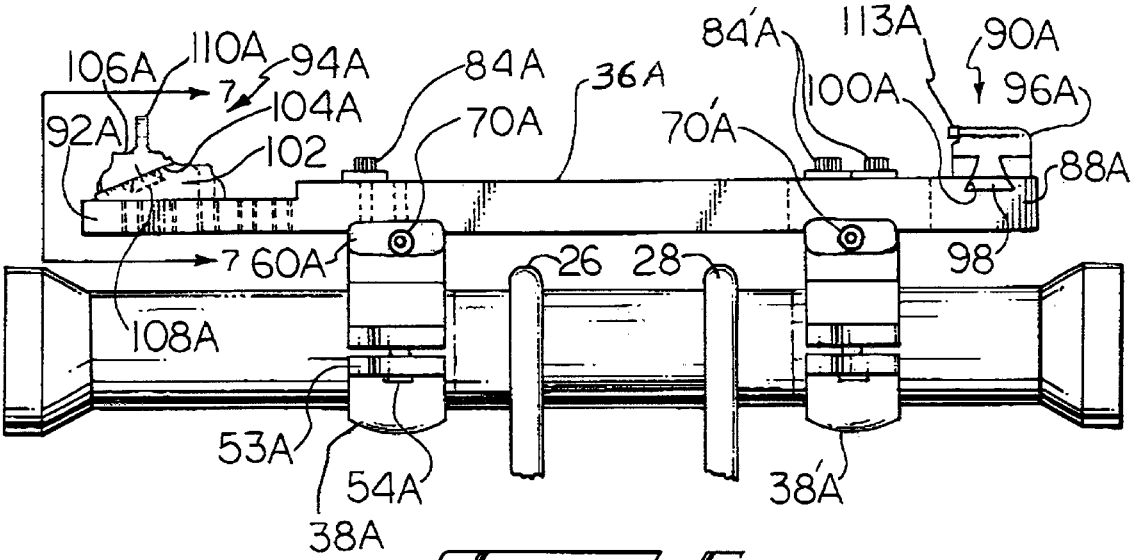
FIG. 6 is a side elevational view, similar to FIG. 2, illustrating a slightly modified embodiment.

Referring now to FIGS. 6 and 7, an alternate embodiment, constructed according to the present invention, generally designated 10A, is similar in many respects to the open sight mounting apparatus 10 and generally similar parts will be identified by generally similar reference characters followed by the letter subscript A. The sighting bar 36A differs from the sighting bar 36 in that, rather than having front and rear independently adjustable sight mounting slides, the sighting bar 36A is one piece. Although the front and rear sight mounting portions 88A and 92A respectively, are not longitudinally moveable relative to each other, the sight bar 36A is still longitudinally moveable relative to the sighting rings 38A and 38'A by selectively adjusting nuts 84A, 84'A, and set screws 70A and 70'A.

Instead of a peep sight, the rear sight 94A includes a V-shaped sight 110A having an upwardly opening V-shaped slot 111 having downwardly converging surfaces 115 which meet at a central groove 117 that is aligned with a front bead sight 113A.

Second Alternate Embodiment

Figure 8:
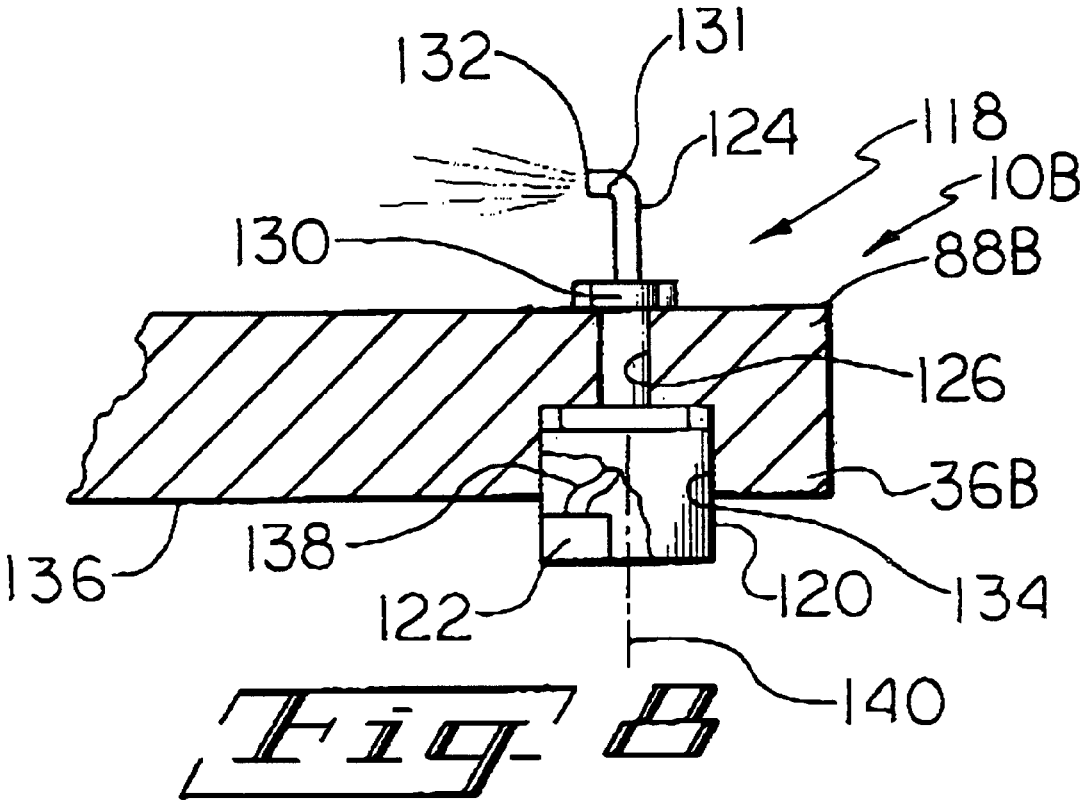
FIG. 8 is a greatly enlarged sectional side view, illustrating another slightly modified optical sighting system; part of the front sight being broken away to better illustrate an enclosed battery and light emitting diode.

Referring now to FIG. 8, another embodiment, generally designated 10B, is generally similar to the embodiment illustrated in FIGS. 1–6 and generally similar reference parts are identified by generally similar references characters followed by the letter B subscript.

The sighting apparatus 10B illustrated in FIG. 8 differs in that, rather than a blade sight 90 being mounted on the front sight bar mount portion 88B, an optical sight, generally designated 118, is provided and includes a lower cylindrical housing 120 mounting a power supply such as a cadium battery, schematically designated 122. The cylindrical housing 120 includes a reduced diameter upper hollow cylindrical stem portion 124 which is received in a bore 126 provided in the front portion 88B of the sighting bar 36B. The upper end of the reduced diameter stem 124 is threaded and is detachably coupled to the sighting bar 36B via a nut 130 which is threaded thereon.

The upper end 131 of the upper stem 124 has a reduced diameter, rearwardly, opening, elbow 131 which mounts a light emitting diode 132. A counter bore 134 of enlarged diameter is provided in the lower surface 136 of sighting bar 36B for receiving the enlarged diameter cylindrical housing 120. By threading the nut 130 onto the upper cylindrical housing 124, the power supply housing stem 12D is clamped in position on the underside of sighting bar 36B.

The light emitting diode 132 is coupled to the power supply 124 via suitable electrical connections 138 received in the housing 124 to couple the light emitting diode 132 in circuit with the power supply 122. A switch, not shown, selectively interrupts the circuit and is activated by turning the cylindrical housing 120 about its vertical axis 140.

The construction of the optical sight 118 is of conventional construction and is routinely utilized on bows for propelling arrows. A suitable sight is one distributed by Sight Master Inc., 1093 Highway 12 East, Townsend, Mont. 59644 under the trademark SIGHTMASTER.

If desired, the vertical position of the light emitting diode 132 can be adjusted by placing a washer around the threaded portion of stem 124 below the nut 130.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination with a sighting telescope;

a sighting system for mounting atop said sighting telescope comprising:

a light emitting front sight;

a rear sight; and mount means for mounting said light emitting front sight and said rear sights in longitudinally spaced apart positions atop said elongate sighting telescope including an elongate sighting bar having a rearward end portion mounting said rear sight;

a forward end portion mounting said light emitting front sight forwardly of said rear sight; and an intermediate portion coupling said forward and rearward end portions together.

2. In combination with a sighting telescope, a sighting system for mounting atop said sighting telescope comprising:

a front sight comprising light emitting means;

a rear sight;

an elongate sighting bar having a front end portion mounting said front sight;

a rear end portion mounting said rear sight; and an intermediate portion coupling said front and rear end portions; and sight bar mount means, coupled to said intermediate portion of said sighting bar between said front and rear open sights, for mounting said sighting bar on said elongate sighting telescope.

3. The combination set forth in claim 2 wherein said front end portion includes a vertical aperture therethrough, said light emitting means extending upwardly through said aperture and including an upper terminal end projecting above said front end portion.

4. The combination set forth in claim 2 wherein said front end portion includes an upstanding aperture therethrough; said light emitting means including a lower portion disposed in said aperture and an upper terminal end portion disposed above said front end portion.

5. The combination set forth in claim 4 wherein said lower portion comprises power supply means.

6. The combination set forth in claim 2 including power supply means; said light emitting means comprising a housing including upper and lower portions; said lower portion mounting power supply means; said upper portion including a light emitting member; said light emitting means including means for selectively coupling said power supply means in circuit with said light emitting member.

7. The combination set forth in claim 6 wherein said front end portion comprises an aperture therethrough receiving said power supply means.

8. In combination:

a firearm for discharging a projectile at a target;

an elongate sighting telescope for aiming said firearm at the target;

telescope mount means coupled to said telescope for mounting said telescope atop said firearm;

front and rear non-telescopic firearm aiming sights, adapted to be aligned with each other, for aiming said firearm at the target;

means for mounting said front and rear non-telescopic sights in alignmen with the target on said telescope comprising an elongate sighting bar having a front end portion mounting said front non-telescopic firearm aiming sight forwardly of said telescope mount means, a rear end portion mounting said rear non-telescopic firearm aiming sight longitudinally rearwardly of said telescope mount means, and an intermediate portion coupling said front and rear end portions together.

9. In combination with an elongate sighting telescope, having a sighting axis, for aiming at a target;

sight mounting apparatus for mounting front and rear non-telescopic sights, adapted to be aligned with each other on the target, atop said elongate sighting telescope, said apparatus comprising:

an elongate sighting bar having a front end portion for mounting said front sight, a longitudinally rearwardly spaced, rear end portion for mounting said rear sight longitudinally rearwardly spaced from said front sight, and an intermediate portion coupling said front and rear end portions for relative longitudinal movement to any selected one of a plurality of different, longitudinally spaced apart positions;

means for mounting said elongate sighting bar externally atop said elongate tubular sighting telescope; and securing means for detachably securing said front and rear end portions together in any selected one of said plurality of different, longitudinally spaced apart positions.

10. The combination set forth in claim 9 wherein said rear end portion includes a section rearwardly of said mounting means for mounting said rear sight rearwardly of said mounting means; said front end portion including a section forwardly of said mounting means for mounting said front sight forwardly of said mounting means.

11. In combination with an elongate sighting telescope, apparatus for mounting front and rear sights atop said elongate sighting telescope comprising:

an elongate front sighting bar for mounting said front sight;

an elongate rear sighting bar for mounting said rear sight;

means slidably coupling said front and rear sighting bars together for relative sliding movement relative to each other to a plurality of different, longitudinally adjusted, relative positions; and longitudinally spaced apart front and rear mount means for mounting said front and rear sighting bars, respectively, atop said elongate sighting telescope in any selected one of said plurality of different, longitudinally adjusted relative positions.

12. In combination with a tubular body adapted to internally mount a telescopic sighting system;

sight mounting apparatus for mounting front and rear non-telescopic sighting elements, adapted to be aligned with each other on a target, externally of said tubular body comprising:

elongate mounting bar means including a front end portion for mounting said front non-telescopic sighting element, and a rear end portion, mounted on said front end portion, for mounting said rear non-telescopic sighting element in spaced apart relation with said front non-telescopic sighting element; and means for mounting said bar means externally of said tubular body in spaced apart relation with said tubular body.

13. In combination with an elongated sighting telescope, having a sighting axis, adapted to be aligned with a target;

front and rear non-telescopic sights, adapted to be aligned with each other on the target sight mounting apparatus for mounting said front and rear non-telescopic sights atop said elongate sighting telescope comprising:

an elongate sighting bar having a front end portion for mounting said front sight, a longitudinally rearwardly spaced, rear end portion for mounting said rear sight longitudinally rearwardly spaced from said front sight; and an intermediate portion coupling said front and rear end portions; and means for mounting said elongate sighting bar externally atop said elongate tubular sighting telescope;

said intermediate portion including means adjustably mounting said front and rear end portions for longitudinal movement relative to each other; and means for detachably securing said front and rear end portions in any selected one of a plurality of different, longitudinally adjusted, relative positions.

14. In combination with an elongate sighting telescope having a sighting axis, adapted to be aligned with a target;

a front non-telescopic sight comprising light emitting means;

a rear non-telescopic sight;

said front and rear non-telescopic sights being adapted to be aligned with each other on a target;

sight mounting apparatus for mounting said front non-telescopic sight and said rear non-telescopic sight atop said elongate sighting telescope;

said sight mounting apparatus comprising:

an elongate sighting bar having a front end portion for mounting said front sight, a longitudinally rearwardly spaced, rear end portion for mounting said rear sight longitudinally rearwardly spaced from said front sight; and an intermediate portion coupling said front and rear end portions; and means for mounting said elongate sighting bar externally atop said elongate tubular sighting telescope.

15. In combination with an elongate sighting telescope, having a sighting axis, adapted to be aligned with a target;

sight mounting apparatus for mounting front and rear non-telescopic sights, adapted to be aligned with each other on the target, atop said elongate sighting telescope, comprising:

an elongate sighting bar having a front end portion including a front sight mount for mounting said front sight thereon, a longitudinally rearwardly spaced, rear end portion for mounting said rear sight longitudinally rearwardly spaced from said front sight; and an intermediate portion coupling said front and rear end portions;

means for mounting said elongate sighting bar externally atop said elongate tubular sighting telescope; and means for mounting said front sight mount on said front end portion for vertical movement relative to said sighting bar.

16. In combination with longitudinally spaced apart mount members, spaced apart a predetermined longitudinal distance, for mounting an elongate sighting telescope on a firearm;

front and rear non-telescopic firearm aiming sights, adapted to be, aligned with each other for aiming the firearm;

sight mounting apparatus for mounting said front and rear non-telescopic firearm aiming sights atop the elongate sighting telescope, said apparatus comprising:

an elongate sighting bar having a front end portion for mounting said front firearm aiming sight, a longitudinally rearwardly spaced, rear end portion for mounting said rear sight longitudinally rearwardly spaced from said front firearm aiming sight; and an intermediate portion coupling said front and rear end portions; and means for mounting said elongate sighting bar externally atop the elongate sighting telescope;

said sighting bar having a length greater than said longitudinal distance between said mount members.

17. A firearm sighting system for a firearm and an elongate firearm sighting telescope mounted thereon, said firearm sighting system comprising:

front and rear non-telescopic firearm aiming sight means, adapted to be aligned with each other on a target;

sight mounting apparatus for mounting said front and rear non-telescopic firearm aiming sight means including:

an elongate sighting bar having a front end portion for mounting said front non-telescopic firearm aiming sight means, a longitudinally rearwardly spaced, rear end portion for mounting said rear non-telescopic firearm aiming sight means longitudinally rearwardly spaced from said front non-telescopic sight means, and an intermediate portion coupling said front and rear end portions for relative longitudinal movement to any selected one of a plurality of different, longitudinally spaced apart positions;

means for mounting said elongate sighting bar; and securing means for detachably securing said front and rear end portions together in any selected one of said plurality of different, longitudinally spaced apart positions.

18. The firearm sighting system set forth in claim 17 wherein said rear end portion includes a section rearwardly of said mounting means for mounting said rear non-telescopic firearm sight means rearwardly of said mounting means; said front end section including a section forwardly of said mounting means for mounting said front non-telescopic, firearm aiming sight means forwardly of said mounting means.

19. A sighting system for mounting atop an elongate sighting telescope, adapted to aim a firearm, comprising:

front firearm aiming sight means and rear firearm aiming sight means, adapted to be aligned with each other;

an elongate sighting bar having a front end portion mounting said front firearm aiming sight means;

a rear end portion mounting said rear firearm aiming sight means; and an intermediate portion coupling said front and rear end portions; and sight bar mount means, coupled to said intermediate portion of said sighting bar between said front and rear firearm aiming sight means, for mounting said sighting bar.

20. A firearm sighting system for a firearm and an elongate sighting telescope mounted thereon, said sighting system comprising:

front and rear non-telescopic firearm aiming sight means, adapted to be aligned with each other on a target;

sight mounting apparatus for mounting said front and rear non-telescopic firearm aiming sight means, including:

an elongate sighting bar having a front end portion for mounting said front non-telescopic firearm aiming sight means, a longitudinally rearwardly spaced, rear end portion for mounting said rear non-telescopic firearm aiming sight means longitudinally rearwardly spaced from said front non-telescopic firearm aiming sight means: and an intermediate portion coupling said front and rear end portions; and means for mounting said elongate sighting bar.

21. The firearm sighting system set forth in claim 20 wherein said intermediate portion includes means adjustably mounting said front and rear end portions for longitudinal movement relative to each other; and means for detachably securing said front and rear portions in any selected one of a plurality of different longitudinally adjusted, relative positions.

22. The firearm sighting system set forth in claim 21 wherein said means for mounting said sighting bar includes longitudinally spaced apart mounting rings, and means for detachable coupling said sighting bar to said mounting rings in any selected one of a plurality of different, longitudinally spaced apart positions.

23. The firearm sighting system set forth in claim 22 wherein said front end portion and said rear end portion are longitudinally adjustably moveable relative to each other; and said means for detachably coupling said sighting bar to said mounting rings includes means for detachably securing said front and rear end portions in any selected one of a plurality of different, longitudinally adjusted, relative positions.

24. The firearm sighting system set forth in claim 20 wherein at least a rear part of said rear end portion is disposed rearwardly of said mounting means and at least a front part of said front end portion is disposed forwardly of said mounting means.

25. The forearm sighting system set forth in claim 20 wherein said front end portion and said rear end portion are slidably coupled together for relative longitudinal movement to any selected one of a plurality of different, longitudinally spaced apart positions; and securing means is provided for detachably securing said front and rear end portions together in any selected one of said plurality of different, longitudinally adjusted, relative positions.

26. The firearm sighting system set forth in claim 25 wherein said rear end portion includes a section rearwardly of said mounting means for mounting said rear open sight rearwardly of said mounting means; said front end portion includes a section forwardly of said mounting means for mounting said front open sight forwardly of said mounting means.

27. The firearm sighting system set forth in claim 20 wherein said front end portion for mounting said front sight means includes means for mounting a light emitting sight.

28. The firearm sighting system set forth in claim 20 including first and second mount means longitudinally spaced apart a predetermined distance for mounting the elongate sighting telescope on said firearm; said means for mounting said sighting bar including front and rear mount means spaced apart a distance greater than said predetermined distance.

29. The firearm sighting system set forth in claim 28 wherein said rear end portion includes a section rearwardly of said rear mount means for mounting said rear sight means rearwardly of said rear mount means; and said front end portion includes a front section forwardly of said front mount means for mounting said front non-telescopic sight means forwardly of said front mount means.

30. The firearm sighting system set forth in claim 20 wherein said means for mounting said sighting bar comprises longitudinally spaced apart front and rear mount members coupled to said front end portion and said rear end portion, respectively.

31. The firearm sighting system set forth in claim 20 wherein said front sight means comprises light emitting means mounted on said front end portion.

32. The firearm sighting system set forth in claim 31 wherein said front end portion includes a recess receiving said light emitting means.

33. The firearm sighting system set forth in claim 31 wherein said front end portion includes upper and lower faces including a vertical aperture extending through said front end portion from said upper face to said lower face; said light emitting means including power supply means mounted on said lower face of said front end portion and light emitting diode means on the upper face of said front end portion; and means disposed in said aperture coupling said light emitting diode means to said power supply means.

34. The firearm sighting system set forth in claim 20 wherein said means for mounting said sighting bar includes means for mounting said sighting bar vertically.

35. The firearm sighting system set forth in claim 20 wherein said front end portion includes a front sight mount for mounting said front sight means thereon, and means mounting said front sight mount on said front end portion for vertical movement relative to said sighting bar.

36. A firearm sighting system for a firearm and an elongate firearm sighting telescope mounted thereon, said sighting system comprising:

front and rear non-telescopic firearm aiming sight means, adapted to be aligned with each other on a target;

sight mounting apparatus for mounting said front and rear non-telescopic firearm aiming sight means, including:

elongate sighting bar having a front end portion for mounting said front non-telescopic firearm aiming sight means; and a rear end portion mounted on said front end portion for mounting said rear non-telescopic firearm aiming sight means longitudinally rearwardly spaced from said front non-telescopic firearm aiming sight means; and an intermediate portion coupling said front and rear end portions together; and front and rear longitudinally spaced apart mount members coupled to said intermediate portion of said sighting bar between said front and rear sight means for mounting said sighting bar.

37. Apparatus for mounting front and rear non-telescopic firearm aiming sights atop an elongate firearm sighting telescope comprising:

an elongate front sighting bar for mounting said front non-telescopic firearm aiming sight;

an elongate rear sighting bar for mounting said rear non-telescopic firearm aiming sight;

mean slidably coupling said front and rear sighting bars together for relative sliding movement relative to each other to any selected one of a plurality of different, longitudinal adjusted, relative positions: and longitudinally spaced apart front and rear mount means for mounting said front and rear sighting bars, respectively, in any selected one of said plurality of different, longitudinal adjusted positions.

38. A sighting system for mounting atop an elongate sighting telescope comprising:

a light emitting front firearm aiming sight;

a rear firearm aiming sight; and mount means for mounting said light emitting front firearm aiming sight and said rear firearm aiming sight in longitudinally spaced apart positions including an elongate sighting bar having a rearward end portion mounting said rear firearm aiming sight;

a forward end portion mounting said light emitting firearm front aiming sight forwardly of said rear firearm aiming sight; and an intermediate portion coupling said forward and rearward end portions together.

39. The sighting system set forth in claim 38 wherein said forward end portion includes a vertical bore through said sighting bar; a sight mount, mounting said light emitting front sight thereon, vertically slidably moveably mounted in said vertical bore for movement to any selected one of a plurality of vertically spaced apart positions.

40. The sighting system set forth in claim 39 wherein said sight mount comprises a housing having a lower portion for mounting a power supply and an upper portion for mounting a light emitting member, and means is provided for selectively coupling said power supply in circuit with said light emitting member; said light emitting member being disposed above said forward end portion.

41. A firearm sighting system for a firearm mounting a tubular body and a telescopic firearm sighting system mounted internally of the tubular body, said firearm sighting system comprising:

front and rear non-telescopic firearm aiming sight means, adapted to be aligned with each other at a target;

sight mounting apparatus for mounting said front and rear non-telescopic firearm aiming sight means, comprising:

elongate mounting bar means including a front end portion for mounting said front non-telescopic firearm aiming sight means, and a rear end portion, mounted on said front end portion, for mounting said rear non-telescopic sight means in spaced apart relation with said front sight means; and means for mounting said bar means.

* * * * *